US006732753B2

(12) United States Patent
Chang

(10) Patent No.: US 6,732,753 B2
(45) Date of Patent: May 11, 2004

(54) UMBRELLA FRAME

(76) Inventor: Wei-Chen Chang, 30, Ko Wha Street, Cha Yi City (TW)

( * ) Notice: Subject to any disclaimer, the term of this patent is extended or adjusted under 35 U.S.C. 154(b) by 326 days.

(21) Appl. No.: 09/761,520

(22) Filed: Jan. 16, 2001

(65) Prior Publication Data

US 2002/0092550 A1 Jul. 18, 2002

(51) Int. Cl.[7] ..... A25B 25/14
(52) U.S. Cl. ..... 135/20.3; 135/98; 242/395
(58) Field of Search ..... 135/15.1, 20.1, 135/20.3, 25.4, 98, 99; 211/197; 242/395

(56) References Cited

U.S. PATENT DOCUMENTS 2,914,154 A * 11/1959 Russell ..... 135/20.3
4,319,600 A * 3/1982 Roche
4,386,621 A * 6/1983 Redl ..... 135/20.1
4,567,907 A * 2/1986 Dubinsky
4,619,281 A * 10/1986 Redl et al. ..... 135/20.3
4,622,987 A * 11/1986 Redl et al.
4,993,445 A * 2/1991 Dubinsky
5,020,557 A * 6/1991 Apple
5,437,297 A * 8/1995 Crisman et al. ..... 135/20.1
5,601,103 A * 2/1997 Dubinsky
5,617,888 A * 4/1997 Wu
5,711,333 A * 1/1998 Vanderminden, Sr. ..... 135/20.3
5,884,859 A * 3/1999 Ma ..... 242/395

* cited by examiner

*Primary Examiner*—Carl D. Friedman
*Assistant Examiner*—Winnie Yip
(74) *Attorney, Agent, or Firm*—Alan Kamrath; Rider, Bennett, Egan & Arundel, LLP

(57) ABSTRACT

An umbrella frame has a hollow shaft, an upper runner disposed on the hollow shaft, a lower runner receiving the hollow shaft, a winding device inserted through the hollow shaft, a pulley disposed on the hollow shaft, and a thread connected to the pulley and the winding device. A plurality of ribs are connected to the upper runner. A plurality of stretchers are connected to the lower runner and the ribs. A handle engages with the winding device.

2 Claims, 6 Drawing Sheets

UMBRELLA FRAME

BACKGROUND OF THE INVENTION

The present invention relates to an umbrella frame. More particularly, the present invention relates to an umbrella frame which has a winding device to be operated safely.

A conventional umbrella frame has an upper runner and a lower runner as shown in U.S. Pat. No. 4,567,907, U.S. Pat. No. 4,993,445, U.S. Pat. No. 5,020,557, U.S. Pat. No. 4,622,987, and U.S. Pat. No. 4,319,600. The conventional umbrella frame further has a conventional winding device to control a stretch of the umbrella frame. However, the umbrella frame will be folded suddenly while the winding device is loosened.

SUMMARY OF THE INVENTION

An object of the present invention is to provide an umbrella frame which has a winding device to be operated safely.

Another object of the present invention is to provide an umbrella frame which has a winding device to adjust a stretch operation of the umbrella frame.

Accordingly, an umbrella frame comprises a hollow shaft, an upper runner disposed on the hollow shaft, a lower runner receiving the hollow shaft, a winding device inserted through the hollow shaft, a pulley disposed on the hollow shaft, and a thread connected to the pulley and the winding device. A plurality of ribs are connected to the upper runner. A plurality of stretchers are connected to the lower runner and the ribs. The hollow shaft has two through holes, and two pairs of oblong grooves communicating with the through holes. A handle has a round hole, a channel, a circular hole communicating with the channel, a first pawl, and a second pawl. A coiled spring and an annular cushion are inserted in the channel of the handle. A blocking rod is inserted through the circular hole of the handle, the coiled spring, and the annular cushion. The winding device has a winding shaft, a pair of annular blocks, a pair of sleeves, a pair of elastic washers, and an annular cover. The winding shaft has a groove and a first end and a second end each passing through the respective annular block, the respective sleeve, and the respective elastic washer. The first end of the winding shaft is inserted in the annular cover. The second end of the winding shaft is inserted in the round hole of the handle. Each of the annular blocks has a collar having two protrusions for insertion into the oblong grooves of the hollow shaft, and a plurality of blocking bars each having a bevel and a click end. The thread has a blocking end for insertion in the groove of the winding shaft.

DETAILED DESCRIPTION OF THE INVENTION

Figure 1:
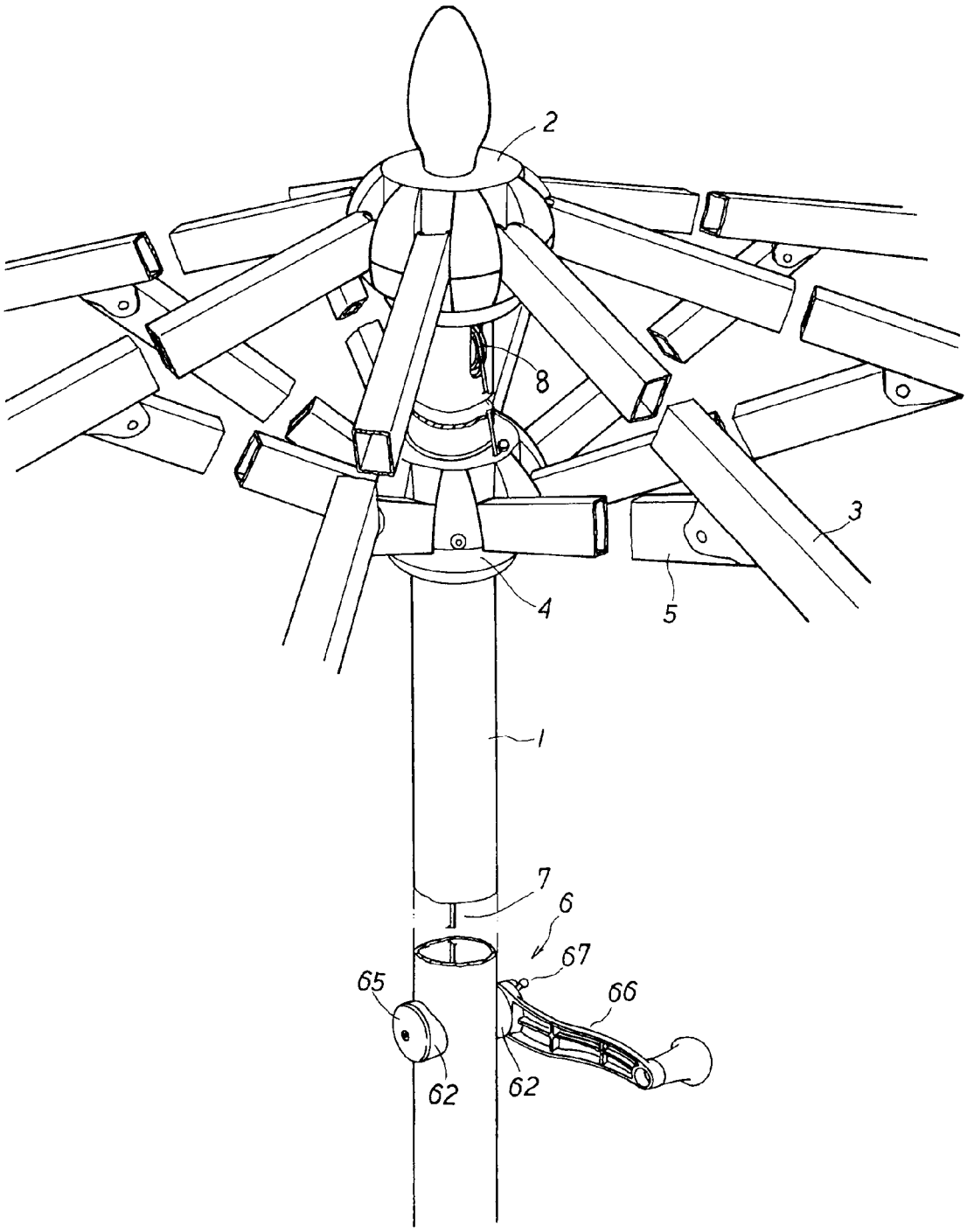
FIG. 1 is a perspective assembly view of an umbrella frame of a preferred embodiment in accordance with the present invention.
Figure 2:
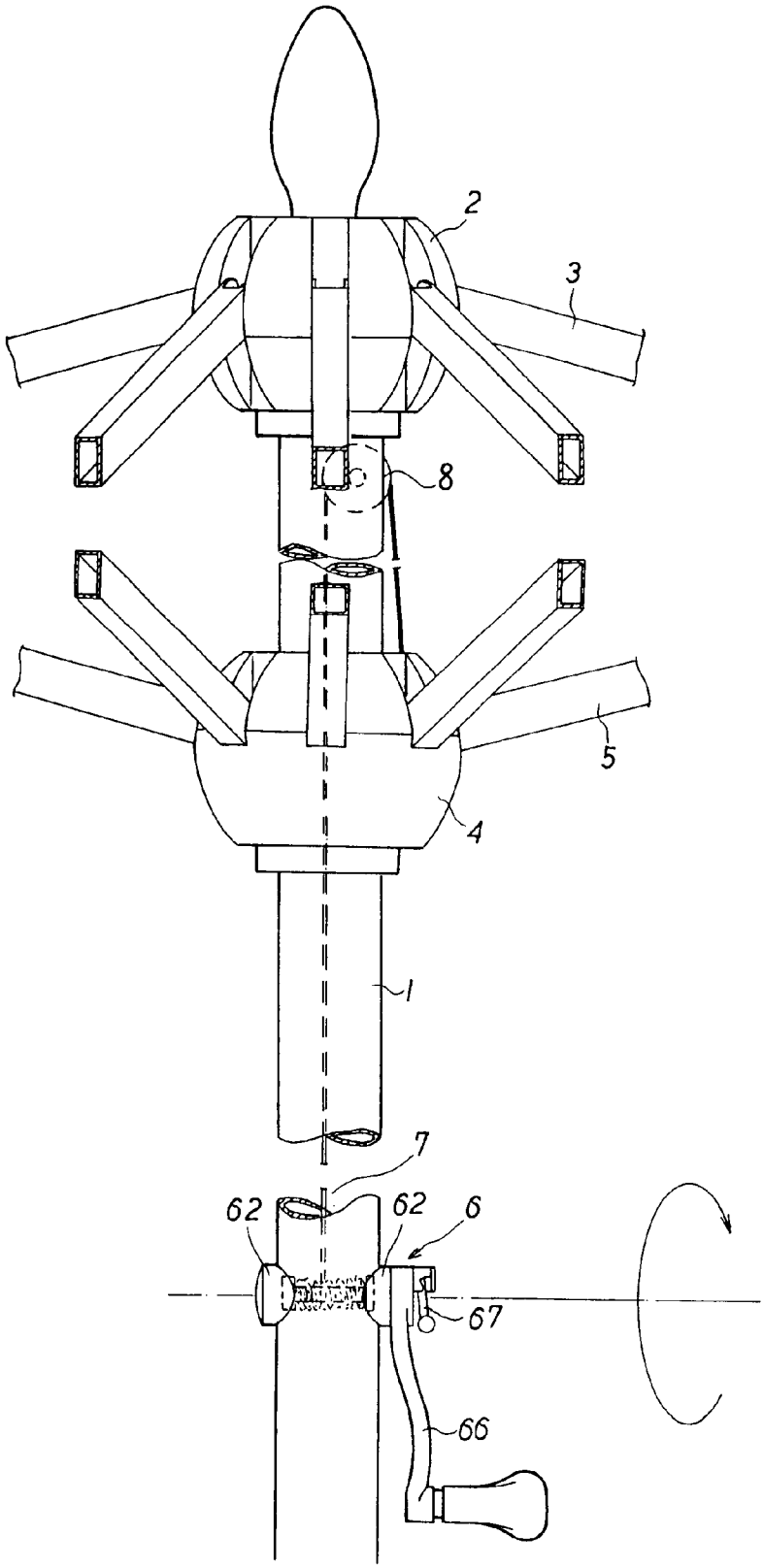
FIG. 2 is a partially perspective view of FIG. 1.
Figure 3:
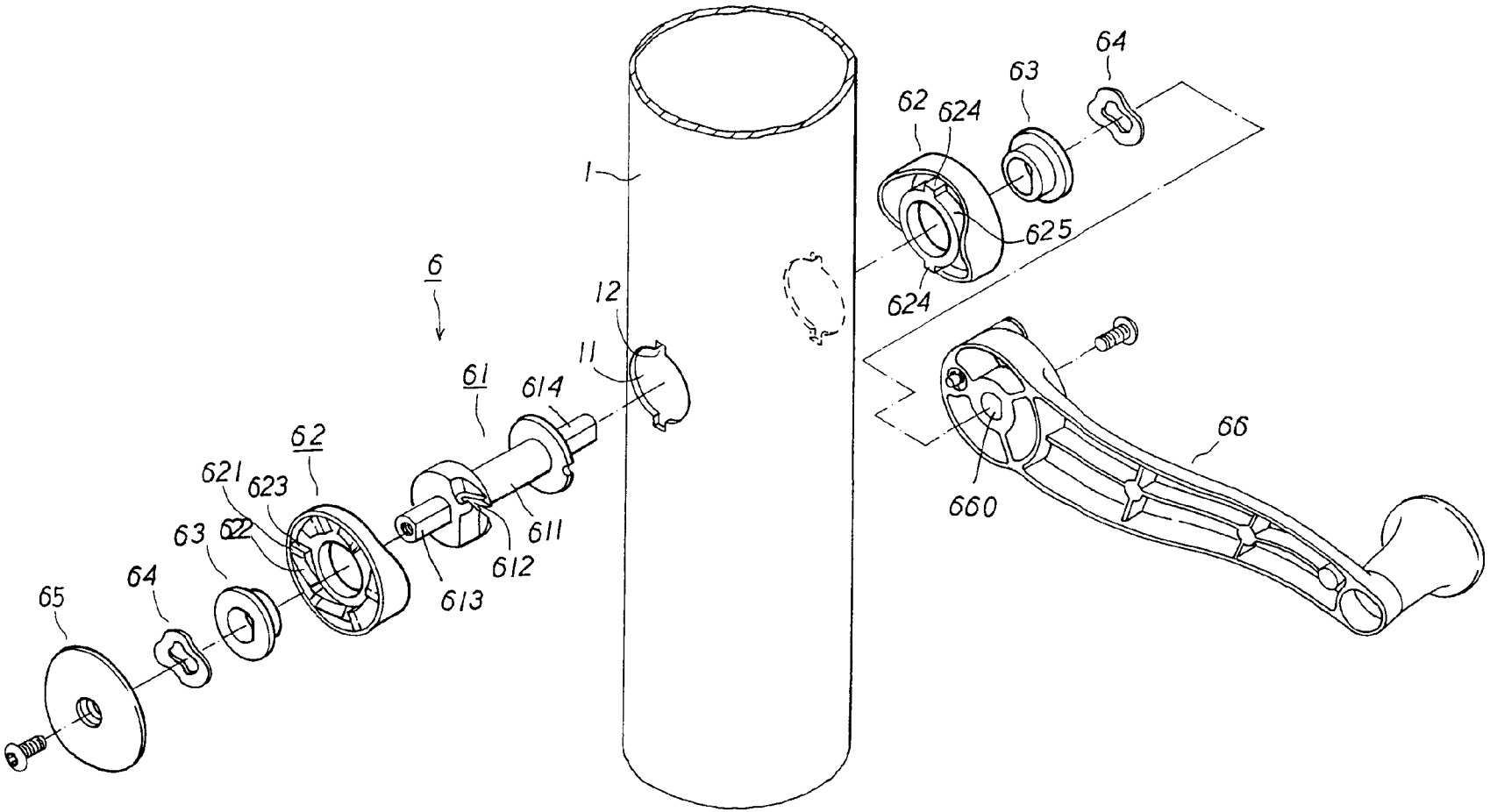
FIG. 3 is a perspective exploded view of a winding device of a preferred embodiment in accordance with the present invention.
Figure 4:
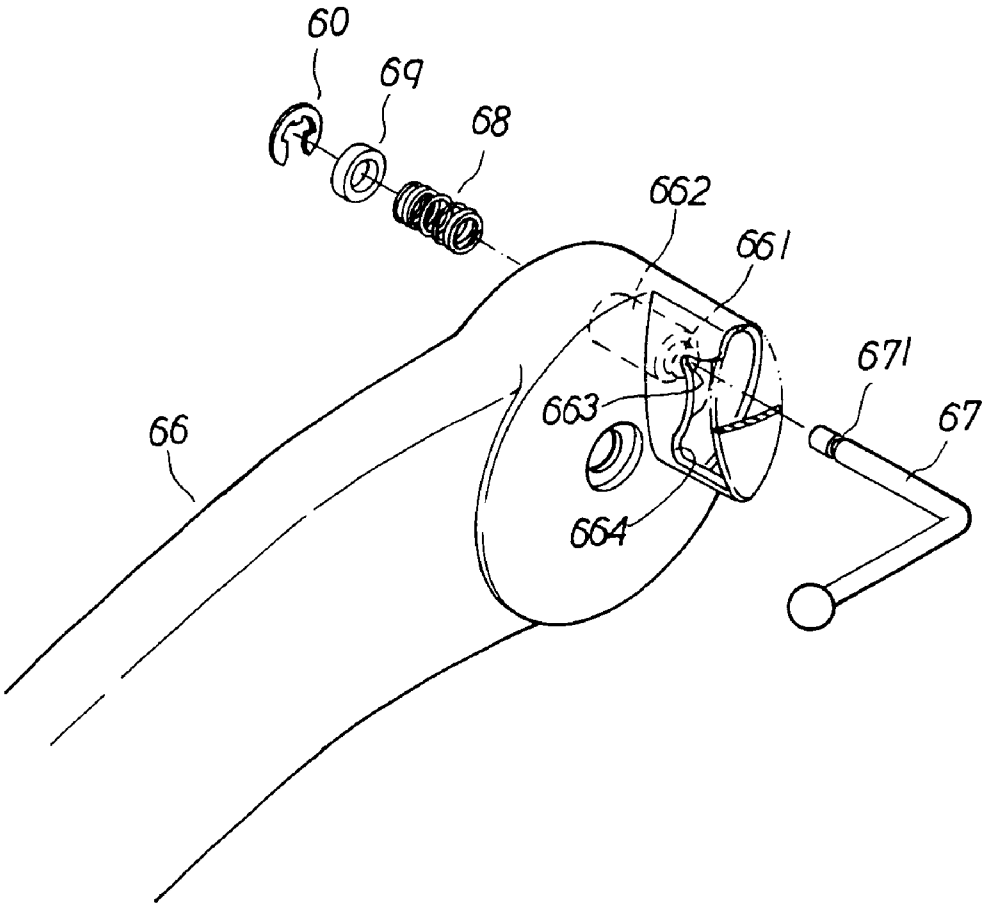
FIG. 4 is a perspective exploded view of a handle of a preferred embodiment in accordance with the present invention.
Figure 5:
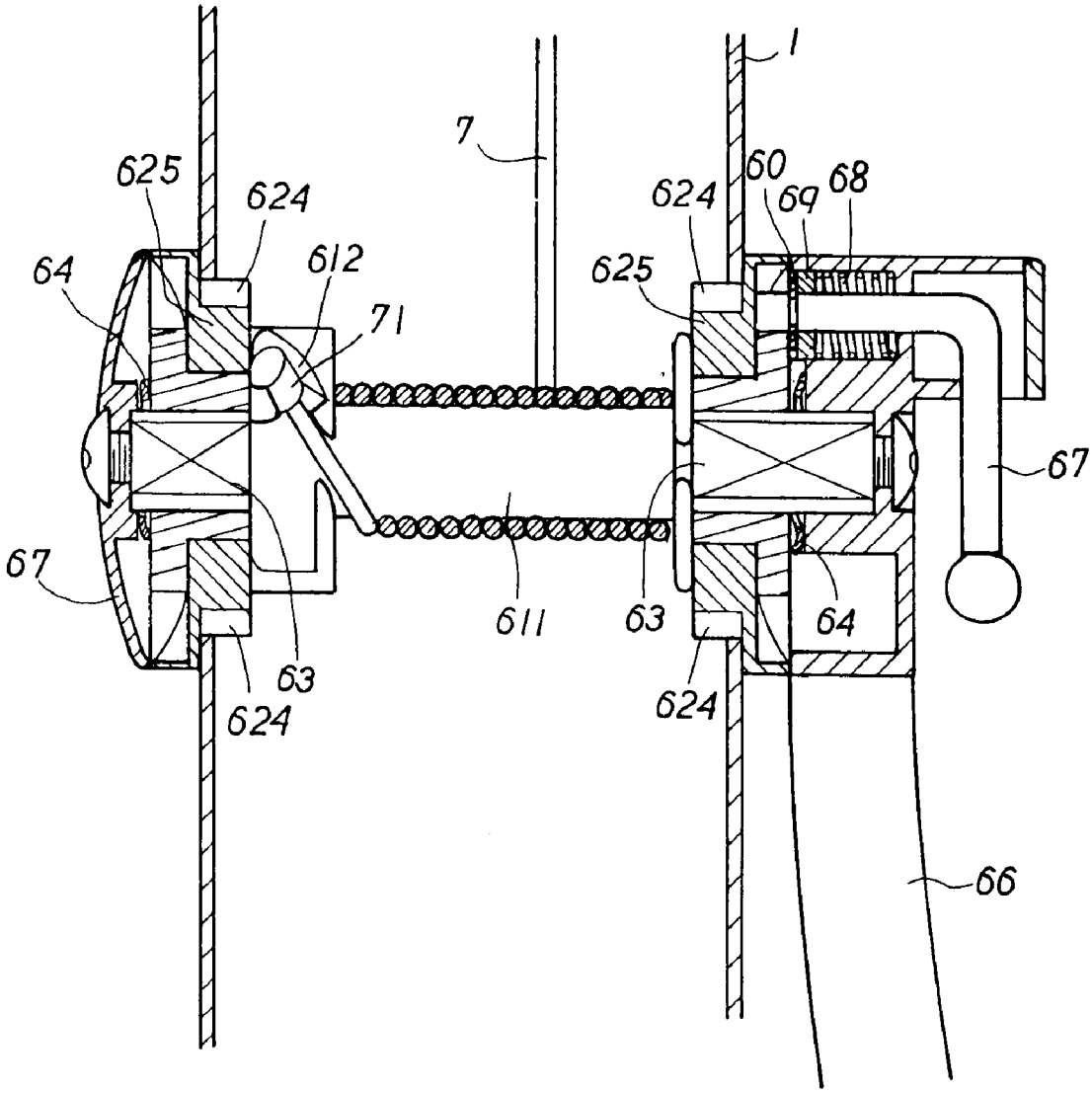
FIG. 5 is a sectional assembly view of a winding device of a preferred embodiment in accordance with the present invention.
Figure 6:
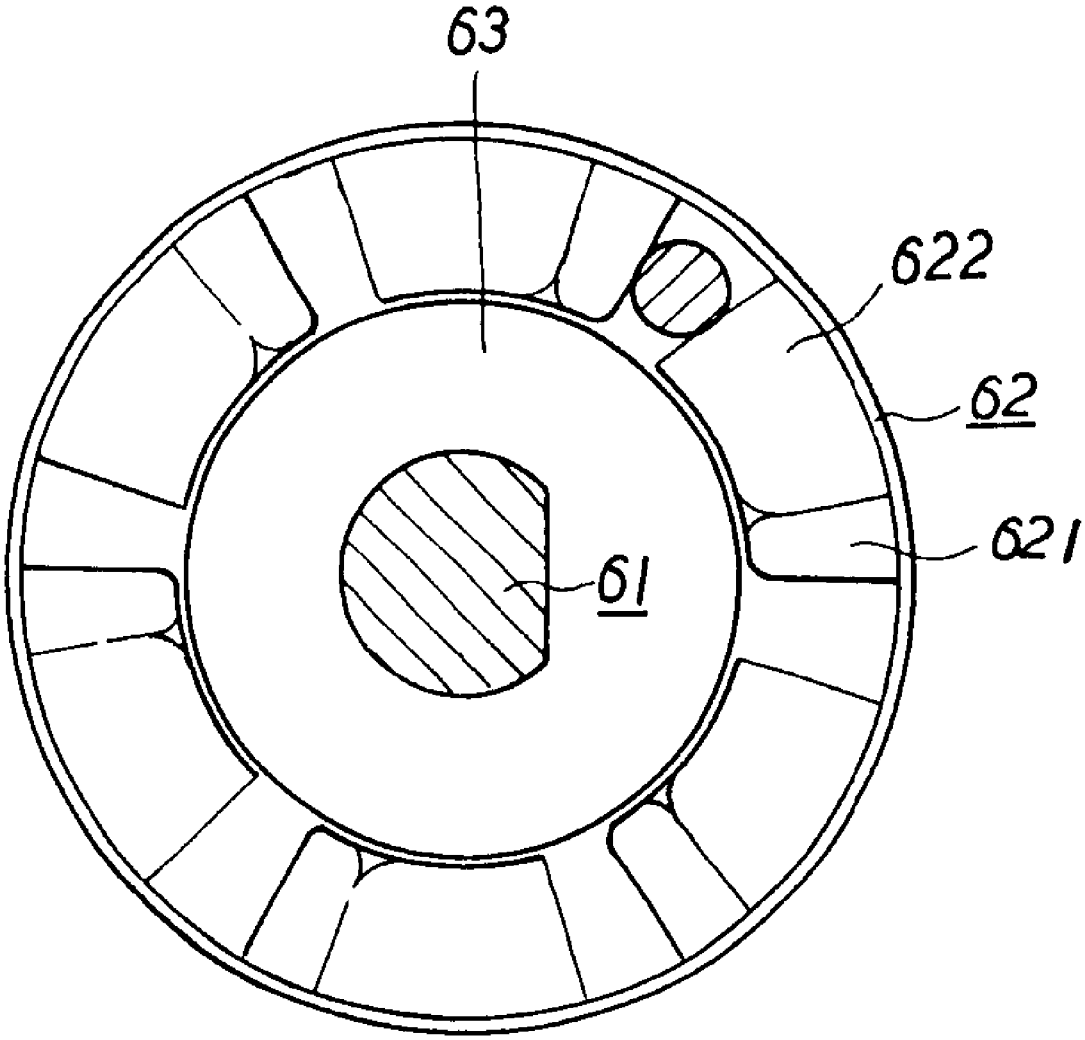
FIG. 6 is a schematic view illustrating a blocking operation of a winding device of a preferred embodiment in accordance with the present invention.

Referring to FIGS. 1 to 6 first, an umbrella frame comprises a hollow shaft 1, an upper runner 2 disposed on the hollow shaft 1, a lower runner 4 receiving the hollow shaft 1, a winding device 6 inserted through the hollow shaft 1, a pulley 8 disposed on the hollow shaft 1, and a thread 7 connected to the pulley 8 and the winding device 6. A plurality of ribs 3 are connected to the upper runner 2. A plurality of stretchers 5 are connected to the lower runner 4 and the ribs 3.

The hollow shaft 1 has two through holes 11, and two pairs of oblong grooves 12 communicating with the through holes 11.

A handle 66 has a round hole 660, a channel 662, a circular hole 661 communicating with the channel 662, a first pawl 663, and a second pawl 664.

A coiled spring 68 and an annular cushion 69 are inserted in the channel 662 of the handle 66.

An L-shaped blocking rod 67 has an annular recess 671. The L-shaped blocking rod 67 is inserted through the circular hole 661 of the handle 66, the coiled spring 68, and the annular cushion 69.

A retainer 60 encloses the annular recess 671 of the L-shaped blocking rod 67, The winding device 6 has a winding shaft 61, a pair of annular blocks 62, a pair of sleeves 63, a pair of elastic washers 64, and an annular cover 65.

The winding shaft 61 has a groove 612 and a first end 613 and a second end 614 each passing through the respective annular block 62, the respective sleeve 63, and the respective elastic washer 64.

The first end 613 of the winding shaft 61 is inserted in the annular cover 65.

The second end 614 of the winding shaft 61 is inserted in the round hole 660 of the handle 66.

Each of the annular blocks 62 has a collar 625 having two protrusions 624 for insertion into the oblong grooves 12 of the hollow shaft 1, and a plurality of blocking bars 621 each having a bevel 622 and a click end 623.

The thread 7 has a blocking end 71 for insertion in the groove 612 of the winding shaft 61.

Referring to FIGS. 2 to 6 again, to raise the lower runner 4, the handle 66 is freely in a first direction with the end of the L-shaped blocking rod 67 sliding up the bevels 622 and over the click ends 623, with L-shaped blocking by the click end 623 of one of the blocking bars 621 for preventing rotation in the opposite direction. The winding device 6 is loosened by retracting the L-shaped blocking rod 67 beyond the blocking bars 621 such that the handle 66 can rotate in the opposite direction.

The invention is not limited to the above embodiment but various modifications thereof may be made. Further, various changes in form and detail may be made without departing from the scope of the invention.

I claim:

1. An umbrella frame comprises:

a hollow shaft, an upper runner disposed on the hollow shaft, a lower runner receiving the hollow shaft, a winding device inserted through the hollow shaft, a pulley disposed on the hollow shaft, and a thread connected to the pulley and the winding device, a plurality of ribs connected to the upper runner, a plurality of stretchers connected to the lower runner and the ribs, the hollow shaft having two through holes, and two pairs of oblong grooves communicating with the through holes, a handle having a round hole, a channel, a circular hole communicating with the channel, a first pawl, and a second pawl, a coiled spring and an annular cushion inserted in the channel of the handle, a blocking rod inserted through the circular hole of the handle, the coiled spring, and the annular cushion, the winding device having a winding shaft, a pair of annular blocks, a pair of sleeves, a pair of elastic washers, and an annular cover, the winding shaft having a groove and a first end and a second end each passing through the respective annular block, the respective sleeve, and the respective elastic washer, the first end of the winding shaft inserted in the annular cover, the second end of the winding shaft inserted in the round hole of the handle, each of the annular blocks having a collar having two protrusions for insertion into the oblong grooves of the hollow shaft, and a plurality of blocking bars each having a bevel and a click end, and the thread having a blocking end for insertion in the groove of the winding shaft.

2. The umbrella frame as claimed in claim 1, wherein the blocking rod is in an L-shape.

* * * * *